United States Patent [19]

Keeney et al.

[11] Patent Number: 4,516,467

[45] Date of Patent: May 14, 1985

[54] METHOD AND APPARATUS FOR CONTROLLING A ROTARY PERCUSSIVE HYDRAULIC DRILL

[75] Inventors: Keith Keeney, Clintwood, Va.; Dennis J. Wehner, Baden, Pa.

[73] Assignee: Schroeder Brothers Corporation, McKees Rocks, Pa.

[21] Appl. No.: 498,977

[22] Filed: May 27, 1983

[51] Int. Cl.[3] ..... F15B 13/09

[52] U.S. Cl. ..... 91/31; 91/6; 91/513; 91/516; 173/2; 60/421; 60/486

[58] Field of Search ..... 60/422, 420, 421, 484, 60/486; 91/6, 31, 510, 513, 516, 518, 532, 32, 452, 450; 173/2, 8, 29

[56] References Cited

U.S. PATENT DOCUMENTS

| | | | |
|---|---|---|---|
| T986,004 | 9/1979 | Stroup et al. | 91/532 |
| 3,408,901 | 11/1968 | Inhofer | 91/516 |
| 3,865,013 | 2/1975 | Mastaj | 91/513 |
| 3,910,369 | 10/1975 | Chichester et al. | 91/532 |
| 3,916,767 | 11/1975 | Barton | 91/516 |
| 3,979,944 | 9/1976 | Salmi et al. | 173/8 |
| 3,987,623 | 10/1976 | Bianchetta | 60/422 |
| 4,070,858 | 1/1978 | Hand | 91/516 |
| 4,308,787 | 1/1982 | Parquet et al. | 91/516 |
| 4,430,926 | 2/1984 | Wallace | 91/516 |

*Primary Examiner*—Robert E. Garrett
*Assistant Examiner*—Richard S. Meyer
*Attorney, Agent, or Firm*—Webb, Burden, Robinson & Webb

[57] ABSTRACT

A quick changeover hydraulic circuit for use in an auger drive mode or percussion hammer mode, controllable in each mode by the same flow regulator. The circuit comprises a first branch circuit which powers a first auxiliary hydraulic powered device and a hydraulic motor for drill steel rotation. A second branch circuit powers a hydraulic percussion motor for a drill steel hammer or a rotary hydraulic motor for an auger, only one of which is in the circuit at one time. An interbranch circuit comprises a priority flow divider which distributes flow. In a first mode with the percussion motor for the drill steel hammer connected into the second branch the flow is delivered to the steel rotation motor and the first auxiliary device. In a second mode with the auger motor connected into the second branch, combined flow from both branches is delivered to the auger motor.

17 Claims, 2 Drawing Figures

M
P
10
11
12
13
14
16
17
18
19
20
21
24
25
26
27
28
29
30
31
33
34
35
37
38
39
40
41
42
44
46
47
Y
Z

METHOD AND APPARATUS FOR CONTROLLING A ROTARY PERCUSSIVE HYDRAULIC DRILL

DESCRIPTION

BACKGROUND

A problem basic to all rock drills either of the rotary auger type or the rotary percussive type is the variable hardness of the materials being drilled. This variation requires that auger or percussion drills have adjustable energy inputs for substantially constant feed rates. It also makes the ability to quickly switch from a rotary auger drill to a rotary percussive drill very desirable.

Schroeder U.S. Pat. No. 2,804,751 discloses a hydraulic circuit for a rotary auger coal drill having automatic feed control based upon resistance to rotation. U.S. Pat. No. 3,979,944 discloses a hydraulic circuit for typical rotary percussion rock drill having a drill steel rotation motor, impact motor and feed motor supplied by three mutually dependent partial circuits. One pump feeds both the rotation motor and impact tool. Similar circuits are shown in U.S. Pat. Nos. 3,823,784; 3,995,700; 4,023,626; 4,246,973; and 4,356,871.

SUMMARY OF THE INVENTION

It is an object of this invention to provide a quick changeover hydraulic circuit that can be used to power a rotary percussion drill or a rotating auger drill. In each case, the boring or breaking energy is manually controlled by the same actuator, for example, foot pedal and the feed is automatically controlled.

Briefly, according to this invention, a quick changeover hydraulic circuit comprises a first branch circuit having a diversion valve for directing flow to a hydraulically powered apparatus associated with the drill; for example, a flushing water pump. The diversion valve alternatively directs flow to a priority flow divider. A constant volume pump delivers flow to said diversion valve. A second branch circuit comprises inlet and outlet connectors. Either the percussion motor of a rotary percussive drill or an auger motor of a rotating auger drill can be connected between the inlet and outlet connectors. A second constant volume pump delivers flow to the inlet connector. A pressure compensated flow regulator diverts flow around the second pump. An interbranch circuit comprises said priority flow divider for distributing flow to the hydraulically powered means and said inlet connector. In a first mode, with the percussion motor of the rotary percussion drill connected into the second branch, the diversion valve is positioned for the flow from the first pump to be delivered directly to the hydraulically actuated apparatus in said first branch. In this mode, flow from the second pump is delivered to the inlet connector. In a second mode, with the auger motor connected into the second branch, the diversion valve is positioned for directing flow from the first pump to the priority flow divider where it is distributed between the hydraulically operated means in said first branch and the second branch. The portion of the flow from the first pump distributed to the second branch is combined with flow from the first motor and supplied to the inlet connector and the auger motor.

Preferably, the interbranch circuit comprises valves in the output conduits of the priority flow divider. Also preferably, each of said first and second branches include a relief control valve in the output of the constant volume pumps. Also preferably, each pump draws hydraulic fluid from a common reservoir to which all hydraulically powered elements return fluid. Preferably, the hydraulic circuit further comprises a third branch circuit having a hydraulic feed motor for driving a carriage supporting either the rotary percussion drill or the rotary auger drill as the case may be. The third branch circuit includes a constant volume pump, a directional control valve and a cross relief valve adjustable to maintain pressure in said motor to present the rock drill to the surface to be drilled. Most preferably, the priority flow divider has the regulated output thereof connected to the first branch and the bypassed output thereof connected to the second branch.

More specifically, there is provided according to this invention a quick changeover hydraulic circuit for use with a rotating auger drill or a rotary percussion drill. With either type drill, the same flow regulator controls the hydraulic energy delivered to the drilling action. The circuit comprises a first branch circuit having a first auxiliary hydraulically operated device therein; for example a water pump for pumping flushing water and a hydraulically driven drill steel rotation motor. A first pressure compensated priority flow divider distributes flow to the first auxiliary device and the drill steel rotation motor. A first diversion valve directs flow to the first flow divider or directly to the first auxiliary device. A second division valve directs flow to the first diversion valve or a third priority flow divider. A first constant volume pump delivers flow to the second diversion valve. The quick changeover hydraulic circuit further comprises a second branch circuit having inlet and outlet connectors between which the percussion motor of a rotary percussion drill may be connected or between which the rotary motor of an auger drill may be connected. Only one device can be connected between the inlet and outlet connectors at one time. The second branch further comprises a second auxiliary hydraulically operated device; for example an air compression motor for creating an oil mist for the drill steel. A second pressure compensated priority flow divider distributes flow to the inlet connector and to the second auxiliary device. A third diversion valve directs flow to the second flow divider or directly to the inlet connector. A second constant volume pump delivers flow to said third diversion valve. A pressure compensated flow regulator diverts flow around the second pump. The quick changeover hydraulic circuit comprises an interbranch circuit comprising the third priority flow divider for distributing flow to the second and third diversion valves. In a first mode, with the percussion motor of the rotary percussion drill connected into the second branch, the first, second and third diversion valves are positioned for the flow from the first pump to be delivered to the first flow divider for distributing flow to the steel rotation motor and the first auxiliary device and for distributing the flow from the second pump to the second priority flow divider for distributing flow to the drill steel percussion motor and the second auxiliary device. In a second mode with the rotary auger connected in the second branch, the first, second, and third diversion valves are positioned for directing flow from the first pump to the third priority flow divider where it distributes flow between the first auxiliary device and the second branch and for delivering flow from the second pump combined with flow from the third priority flow divider to the auger motor.

Preferably, the second flow divider has a check valve in the output conduit thereof connected to the inlet connection and the third diversion valve has a check valve in the outlet thereof connected to the inlet connector. Also preferably, the regulated output of the second flow divider is connected to the second auxiliary means and the bypass output of the second flow divider is connected to the inlet connection. Also preferably, the first flow divider has check valves in the output conduits thereof and the second diversion valve has a check valve in the output thereof connected to the first auxiliary means. Also preferably, regulated output of the first flow divider is connected to the first auxiliary means and the bypass output of the first flow divider is connected to the drill steel rotation motor.

THE DRAWINGS

Further features and other objects and advantages of this invention will become clear from the following detailed description made with reference to the drawings in which:

FIG. 1 is a schematic diagram of the hydraulic circuit with the air compressor drive motor in place; and FIG. 2 is a schematic drawing of the auger rotation motor that may be inserted in place of the air compressor drive motor.

DESCRIPTION OF THE PREFERRED EMBODIMENT

Figures 1, 2:
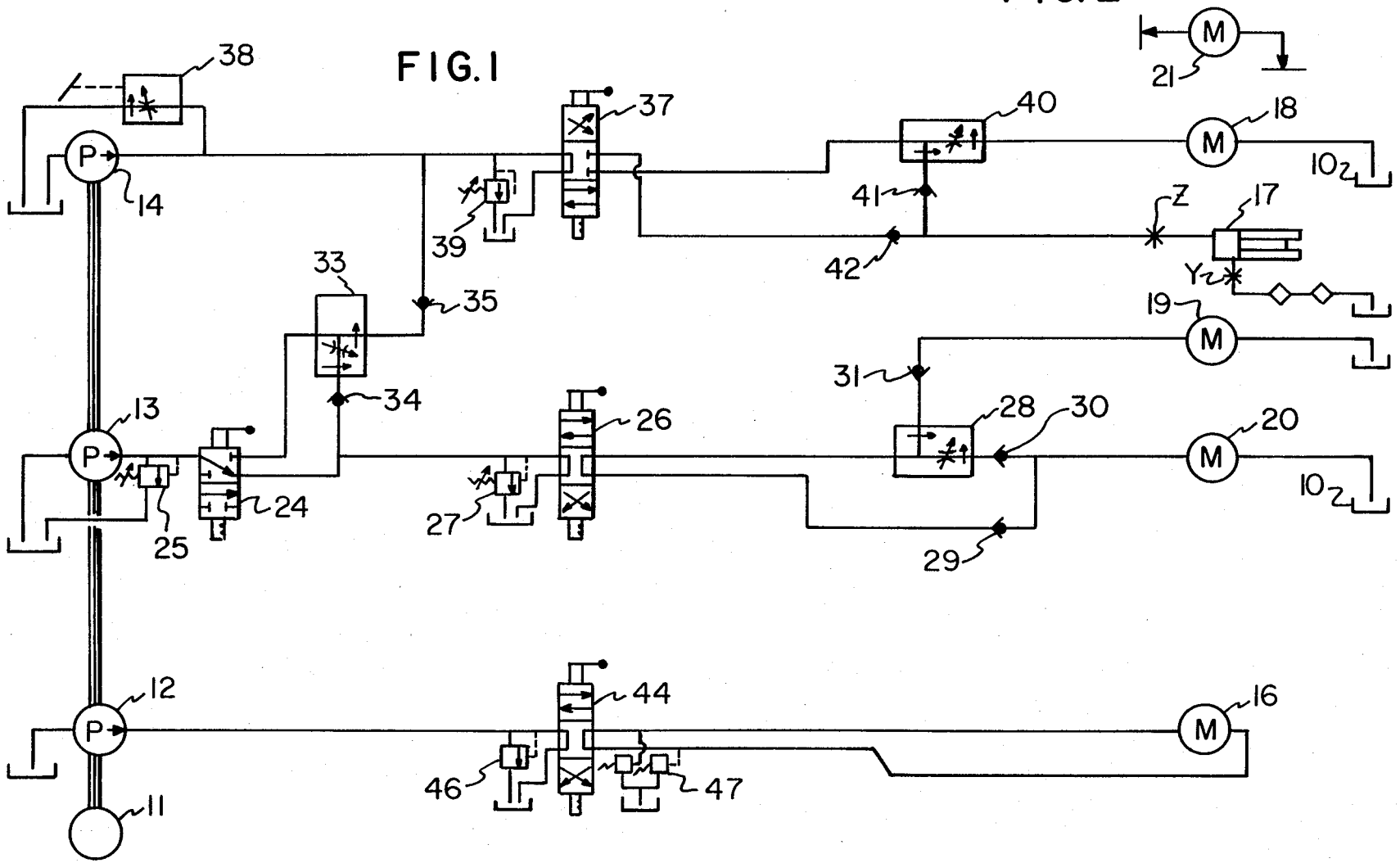

Referring now to the drawings, there is shown a hydraulic system according to this invention. The system comprises four hydraulic circuits that share a common reservoir 10 and a common electric motor drive 11 for the constant volume gear pumps 12, 13, and 14. It should be understood that the branch circuit between pump 12 and feed motor 16 could have its own electric motor and reservoir, although this configuration is not preferred.

The hydraulically powered apparatus served by this circuit and forming a part thereof includes the percussion motor 17 for the rotary percussion drill, and air compressor drive motor 18, the drill steel rotation motor 19, water pump motor 20, and auger rotation motor 21. Either the percussion motor 17 or the auger rotation motor 21 is in the circuit at a given time. Connectors comprising inlet connector "z" and outlet connector "y" enable these devices to be inserted and removed as required.

The percussion motor 17 (percussion section of the drill hammer) carries the striking piston, which in turn strikes the shank of the drill steel. The drill steel is fitted with a cutting bit at its outer end. The bit is placed against the rock to be drilled and the hydraulically actuated reciprocating piston hammers the drill steel causing the rock to be fractured by the bit. In normal operation, the percussion motor can draw up to about thirteen gallons per minute at a pressure of 2400 psi.

The air compressor drive motor 18 is for generating compressed air for carrying an air/oil mist to the front head of the hammer. The mist lubricates the drill steel, the rotation gear (to be explained) and creates a positive pressure in the front drive section of the hammer which acts to exclude contaminants. The oil mist reduces wear of the drill steel shank and the chuck bushing of the drill. The compressed air motor 18 draws about seven gallons per minute in normal operation. The compression motor is auxiliary to the main function of the percussion hammer.

The drill steel rotation drive motor is typically coupled through rotation gearing to a chuck bushing which in turn slidably engages with the steel shank and causes the shank to rotate. This results in the bit hitting the rock in a different position with each blow chipping away the rock. The details or the rotation drive are understood to those skilled in the art. The hydraulic motor 19 draws about ten gallons per minute at 1800 psi.

The water pump motor 20 is used to drive a constant displacement water pump. The water is directed through the hollow drill steel and out openings in the bit to flush away rock cuttings. The flushing water is also useful for boring with an auger as will be explained. It is auxiliary to the main function of either the percussion drill or the rotary auger drill.

As already explained, the auger drive motor 21 can replace the percussion motor 17 in the circuit. The auger drive motor is a hydraulic motor drawing up of thirty gallons per minute. Because of its greater capacity for hydraulic fluid as compared with the percussion motor 17, the motor 21 cannot simply be substituted for the percussion motor without changes to the remainder of the hydraulic circuit.

The feed motor 16 drives a carriage which carries the rotary percussion drill or the rotary auger drill, as the case may be, to the face of the rock.

Constant volume gear pump 13 supplies twenty gallons per minute of hydraulic fluid to the two-position diversion valve 24. This valve may, for example, be manually operated. A relief valve 25 is connected in parallel with the motor 13 having a relief pressure of about 2400 psi. In a first position, the diversion valve 24 directs flow to three-position diversion valve 26. A relief valve 27 with a relief pressure of 1800 psi is positioned at the inlet to the three-position diversion valve 26. In a central position, the diversion valve 26 bypasses flow to the reservoir. In the second position, the diversion valve 26 directs flow to the inlet of flow divider 28. In a third position, diversion valve directs flow around the flow divider 28 through a check valve 29 to the water pump 20.

The flow divider 28 is a pressure compensated flow divider such that the flow at the outputs is unrelated to the input pressure. The flow divider is also a priority divider in that the available fluid is first supplied to the regulated outlet port (connected through check valve 30 to the water pump 20) and later to the bypass output port (connected through check valve 31 to the steel rotation motor 19). Sometime after start-up the twenty gallon per minute flow from constant volume pump 13 is substantially equally divided between both outlet ports of the flow divider.

In a second position, diversion valve 24 directs flow to the input of priority flow divider 33. The regulated output of flow divider 33 is passed through check valve 34 to the input of the diversion valve 26. The bypass output of flow divider 33 is passed through check valve 35 to the input of diversion valve 37.

Constant volume pump 14 delivers its output of twenty gallons per minute to diversion valve 37. A pressure compensated flow regulator 38 (for example, operated by a foot pedal) is in parallel with the pump 14. A relief valve 39 with a relief pressure of about 2400 psi is provided at the input to diversion valve 37. The flow regulator permits flow back around the pump 14 thus controlling the flow presented to diversion valve 37.

The diversion valve 37 has three positions. In a central position, it bypasses the flow received to the reservoir. In a second position, diversion valve 37 directs flow to the input of flow divider 40. Flow divider 40 is similar to the flow dividers 28 and 33 except for the adjustment of out ratios. The regulated output of flow divider 40 is directed to the air compresser motor. This flow is about seven gallons per minute when the input flow is twenty gallons per minute. The bypassed output of the flow divider 40 is passed through check valve 41 to the percussion motor 17 at an approximate rate of thirteen gallons per minute.

In a third position, diversion valve 37 directs flow through check valve 42 to the auger motor 21 (moved into the position of the precussion motor 17).

The constant volume pump 12 delivers its output of ten gallons per minute to three-position diversion valve 44. A relief valve 46 with a relief pressure of about 1800 psi is positioned in the output of constant volume pump 12. In a central position of the valve 44, the output of the pump 12 is bypassed to the reservoir. In second and third positions, the output ports are pressurized and evacuated to drive the feed motor 16 in one direction or the other. A relief valve 47 maintains the pressure drop across the feed motor at about 800 to 1000 psi.

Valves 24, 26, and 37 may be manually positioned to set up the circuit for either driving a percussion motor 17 or a rotating auger motor 21. As shown in the drawing, valves 24, 26, and 37 are positioned with slides "in" or downward when the percussion motor is in place. These same valves are positioned with slides "out" or upward when using the auger unit.

Priority flow dividers 28, 33, and 40 proportion flow and direct the fluid to the proper devices in the proper sequence to accomplish work with the least reaction between the various branches of the circuit.

The sequence of operation for the rotary percussion hammer is as follows: the electric motor 11 is started and each pump delivers fluid into the associated branch of the circuit. Pump 14 will cause a flow to valve 37 and flow regulator 38. Pushing valve 37 to the "in" position will expose this fluid to priority flow regulator 40. But unless the flow regulator 38 is partially closed, the fluid will develop no pressure so neither the air compressor not the percussion motor will operate.

Pump 13 will cause a flow through diversion valve 24 to the valve 26. Placing valve 26 into the "in" position will direct the flow to priority flow divider 28. The priority flow dividers are so designed that the regulated flow must be satisfied first before any flow will appear at the bypass port. This feature causes the water pump motor 20 to start first and operate at a constant speed. Then the steel rotation motor 19 starts. Each output section of the priority flow dividers are pressure compensated so that each section can work at different pressure levels.

At this time, the drill steel is rotating and the flushing water is flowing out of the bit. Pump 12 is causing a flow to valve 44. If this valve is placed in the "in" position, the fluid will be directed to the feed motor and the bit will be advanced to the rock. The pressure of this fluid is under the control of the relief valve 47. Relief valve 47 will be adjusted just strong enough to keep presenting the bit to the rock as the rock chips and is flushed away from the water. At this time, the foot operated flow regulator 38 is slowly closed and fluid is forced into priority flow divider 40. The regulated port must be satisfied first, thus the air compressor runs first and then the percussion motor of the hammer begins to strike the drill steel and drive it into the rock. Thus the holes advance more rapidly.

If the bit advances too rapidly, the feed may not be capable of advancing fast enough to present the bit to the rock. This sometimes occurs in soft rock or coal. At this time, the drill steel and bit may begin to rebound and resonant frequencies may be established in the drill steel. The vocal points of these frequencies can concentrate energy of the hammer piston and cause early drill steel failure at these points. When this occurs, the operator should slightly let up on the foot operated flow regulator 38 and lower the pressure to the percussion section. This will lower the frequency of blows and the energy level of the hammer piston. This may not lower the penetration rate since the feed valve is still in its set position.

When the hole has been advanced to its required depth, the operator opens the foot operated regulator 38 and the percussion motor and air compressor stop. The operator reverses the position of the valve 44 and the drill steel and bit are retracted. Then valve 26 is centered and the drill is positioned for the next hole.

With the circuit as designed, there is no "cross talk" between drill steel rotation motor and percussion motor. Any cross talk or pressure spikes between these two circuits causes spot loading and welding between the drill steel shank and the chuck bushing. This constant spot loading and welding with the percussion constantly breaking it loose results in fast deterioration of the drill steel shank and the chuck bushing of the hammer.

The circuit is so designed that the low energy level devices are satisfied first by the priority flow dividers. This allows the bypass circuit to match its energy level to the load requirement without any ill effects. In the regulated circuit, even if the bypass circuit runs into a stall, the regulated or priority circuit is not affected.

By disconnecting the hammer from the drill carriage and connecting the auger rotation unit at points "y" and "z", the hydraulic circuit will then do duty as a straight rotation auger type drill. This is sometimes preferably for extended periods of drilling in soft rock or coal. With the auger rotation unit in place, valves 24, 26 and 37 will be placed in the "out" position. Valve 24 in the "out" position will direct fluid from pump 13 to priority flow divider 33 where it is first directed to the valve 26 then to a connection with the outlet from pump 14. Pulling valve 26 to the "out" position will direct fluid through check valve 29 to water pump motor 20. If water is not required for auger drilling, the valve 26 can be left in the center position and the fluid will return to the reservoir at very low pressure.

To start the auger, rotation valve 37 is placed in the "out" position. This will direct the fluid through check valve 42 to the connector "x". Slowly closing foot operated flow regulator 38, the fluid from the pump 14 and the bypass fluid from the priority flow divider 33 flow to the auger rotation motor 21. The speed of the auger rotation motor is controlled by the position of the foot operated flow regulator. The auger is fed into the hole the same as before with valve 44.

All of the pumps may do other duties when not being used for drilling. Pump 14 can be used for propelling the drill carriage (tram). Pump 13 can be added to pump 14 by shifting out diversion valve 24. This will give faster tram speed. Pump section 12 may be used for cylinder functions and cable rewind.

Having thus defined the invention in the detail and with the particularity required by the Patent Laws, what is desired protected by Letters Patent is set forth in the following claims.

We claim:

1. A quick changeover hydraulic circuit for use in a first mode or a second mode, controllable in each mode by the same flow regulator comprising:
- a pressure compensated flow regulator;
- a pressure compensated priority flow divider having a regulated output and a bypass output;
- a first branch circuit comprising:
  - a hydraulic powered means;
  - a diversion valve for directing flow to the hydraulic powered means or said priority flow divider;
  - a first constant volume pump for delivering flow to said diversion valve;
- a second branch circuit comprising:
  - inlet and outlet connectors;
  - a hydraulic percussion motor for a drill steel hammer and a rotary hydraulic motor for an auger, only one of which is in the circuit at one time and being between said inlet and outlet connections when in the circuit;
  - a second constant volume pump for delivering flow to the said inlet connector;
  - said pressure compensated flow regulator arranged for diverting flow around said second pump;
- an interbranch circuit comprising;
  - said priority flow divider arranged for distributing flow with the regulated output connected to the hydraulic powered means and the bypass output connected to said inlet connector;
- such that:
  - in a first mode with the hydraulic percussion motor connected into the second branch the diversion valve is positioned for the flow from the first pump to be delivered to the hydraulic powered means in said first branch and for the flow from the second pump to be delivered to the inlet connector and thence to the percussion motor; and
  - in a second mode with the rotary hydraulic motor connected into the second branch the diversion valve is positioned for directing flow from the first pump to the priority flow divider where it distributes flow between the hydraulic powered means in said first branch and the second branch and for delivering flow from the second pump, combined with flow from the flow divider to the inlet connector and thence to the rotary hydraulic motor.

2. The circuit according to claim 1 wherein said interbranch circuit comprises check valves in the two output conduits of the priority flow divider.

3. The circuit according to claim 1 wherein said first and second branches include a relief control valve in the output conduit of the constant volume pumps.

4. The circuit according to claim 1 having a single reservoir from which each pump draws hydraulic fluid and to which all fluid is returned.

5. The circuit according to claim 1 further comprising a third branch circuit having a hydraulic feed motor, a constant volume pump, a direction control valve and a relief valve adjusted to maintain pressure in said feed motor.

6. A quick changeover hydraulic circuit for use in a first mode or a second mode, controllable in each mode by the same flow regulator comprising:
- a pressure compensated flow regulator;
- first, second, and third pressure compensated priority flow dividers;
- a first branch circuit comprising:
  - a first auxiliary hydraulic powered device;
  - a hydraulic motor for drill steel rotation;
  - said first pressure compensating priority flow divider for distributing flow to the said first auxiliary device and said drill steel rotation motor;
  - a first diversion valve for directing flow to the first priority flow divider or the first auxiliary device;
  - a second diversion valve for directing flow to the first diversion valve or said third priority flow divider;
  - a first constant volume pump for delivering flow to said second diversion valve;
- a second branch circuit:
  - inlet and outlet connectors;
  - a hydraulic percussion motor for a drill steel hammer and a rotary hydraulic motor for an auger, only one of which is in the circuit at one time and being between said inlet and outlet connectors when in the circuit;
  - a second auxiliary hydraulic powered device;
  - said second pressure compensated priority flow divider for distributing flow to the said inlet connector and to said second auxiliary device;
  - a third diversion valve for directing flow to the second flow divider or the inlet connector;
  - a second constant volume pump for delivering flow to said third diversion valve;
  - said pressure compensated flow regulator for diverting flow around said second pump;
- an interbranch circuit comprising:
  - said third priority flow divider for distributing flow to the first and third diversion valves;
- such that
  - in a first mode with the percussion motor connected into the second branch the first, second, and third diversion valves are positioned for the flow from the first pump to be delivered to the first flow divider for distributing flow to the steel rotation motor and the first auxiliary device and for the flow from the second pump to be delivered to second priority flow divider for distributing flow to the percussion motor and the second auxiliary device; and
  - in a second mode with the rotary hydraulic motor connected into the second branch, the first, second, and third diversion valves are positioned for directing flow from the first pump to the third priority flow divider where it distributes flow between the first auxiliary device and the second branch and for delivering flow from the second pump combined with flow from the third flow divider to the rotary hydraulic motor.

7. The circuit according to claim 6 wherein said interbranch circuit comprises check valves in the two output circuits of the priority flow divider.

8. The circuit according to claim 6 wherein each of said first and second branches include a relief control valve in the output conduit of the constant volume pump.

9. The circuit according to claim 6 having a reservoir from which each pump draws hydraulic fluid and to which all hydraulic fluid is returned.

10. The circuit according to claim 6 further comprising a third branch circuit having a hydraulic feed motor for a carriage, a constant volume pump, a directional control valve for selecting the direction of movement of the carriage, and a relief valve for adjusting the pressure in said feed motor.

11. The circuit according to claim 6 wherein the third priority flow divider has a regulated output and a bypass output, the regulated output of the third flow divider is passed to the first branch circuit and the bypass output of the third flow divider is passed to the second branch circuit.

12. The circuit according to claim 6 wherein the second flow divider has a check valve in an output conduit thereof connected to the said inlet connector and the third diversion valve has a check valve in an outlet conduit thereof connected to said inlet connector.

13. The circuit according to claim 6 wherein the regulated output of the second flow divider is connected to said second auxiliary means and the bypass output of said second flow divider is connected to said inlet connector.

14. The circuit according to claim 6 wherein the first flow divider has check valves in output conduits thereof and the first diversion valve has a check valve in an output thereof connected to the first auxiliary hydraulic powered device.

15. The circuit according to claim 6 wherein the first priority flow divider has a regulated output and a bypass output, the regulated output of the first flow divider is connected to said first auxiliary hydraulic powered device and the bypass output of the first flow divider is connected to said drill steel rotation motor.

16. The circuit according to claim 6 wherein the first auxiliary hydraulic powered device comprises a water pump for delivering flushing water through the drill steel or auger.

17. The circuit according to claim 6 wherein the second auxiliary hydraulic powered device comprises an air compressor motor for spraying oil on the drill steel.

* * * * *